US011680514B2

(12) United States Patent
Matsuoka et al.

(10) Patent No.: US 11,680,514 B2
(45) Date of Patent: Jun. 20, 2023

(54) LIQUID INJECTION NOZZLE

(71) Applicant: ACR Co., Ltd, Yamato (JP)

(72) Inventors: Hiroshi Matsuoka, Yamato (JP); Hiroshi Noguchi, Yamato (JP); Keiji Kishishita, Yamato (JP)

(73) Assignee: ACR CO., LTD., Yamato (JP)

( * ) Notice: Subject to any disclaimer, the term of this patent is extended or adjusted under 35 U.S.C. 154(b) by 0 days.

(21) Appl. No.: 17/370,612

(22) Filed: Jul. 8, 2021

(65) Prior Publication Data

US 2022/0120211 A1 Apr. 21, 2022

(30) Foreign Application Priority Data

Oct. 15, 2020 (JP) ..... 2020-174182

(51) Int. Cl.
*F02B 23/10* (2006.01)
*F02M 45/02* (2006.01)
*F02M 61/18* (2006.01)

(52) U.S. Cl.
CPC ..... *F02B 23/10* (2013.01); *F02M 45/02* (2013.01); *F02M 61/182* (2013.01); *F02M 2200/46* (2013.01)

(58) Field of Classification Search
CPC ..... F02B 23/10; F02M 45/02; F02M 61/162; F02M 61/18; F02M 61/1806; F02M 61/182; F02M 2200/46
See application file for complete search history.

(56) References Cited

U.S. PATENT DOCUMENTS 4,139,160 A * 2/1979 Rood ..... B05B 1/042 403/372
6,029,913 A * 2/2000 Stroia ..... F02M 61/1806 239/533.2

(Continued)

FOREIGN PATENT DOCUMENTS

CH 645 699 A5 10/1984
DE 102019201567 A1 8/2020

(Continued)

OTHER PUBLICATIONS

European Search Report of corresponding European patent No. EP21176561 dated Oct. 13, 2021.

*Primary Examiner* — John Kwon
*Assistant Examiner* — Johnny H Hoang
(74) *Attorney, Agent, or Firm* — Browdy and Neimark, PLLC

(57) ABSTRACT

This liquid injection nozzle atomizes and sprays liquid, while reducing loss of kinetic energy, thereby promoting mixing between the liquid and a gas and thus promoting the reaction between the liquid and the gas. In the liquid injection nozzle, a plurality of distal end tips each having an injection hole are provided on a distal end portion of a nozzle body. Each distal end tip has a conical swirling flow chamber. A communication thin hole is formed in the distal end portion. The communication thin hole extends from a hollow chamber to the conical swirling flow chamber of the distal end tip. When the valve needle is lifted, liquid flows through the communication thin hole into the swirling flow chamber in a tangential direction and generates a vortex flow, and the vortex flow is sprayed from the injection hole.

7 Claims, 9 Drawing Sheets

(56) References Cited

U.S. PATENT DOCUMENTS

| | | | | |
|---|---|---|---|---|
| 6,378,792 | B2 * | 4/2002 | Fukaya | F02M 61/18 239/533.14 |
| 7,082,921 | B2 * | 8/2006 | Shimizu | F02M 61/162 123/472 |
| 7,513,116 | B2 * | 4/2009 | Hebert | F23R 3/28 60/740 |
| 2009/0255998 | A1 * | 10/2009 | Das | F02M 61/1806 239/533.12 |

FOREIGN PATENT DOCUMENTS

| | | | |
|---|---|---|---|
| JP | H04 86373 | A | 3/1992 |
| JP | 200246340 | A | 9/2003 |
| JP | 2005036672 | A | 2/2005 |
| JP | 2017134317 | A | 8/2017 |
| JP | 2019015253 | A | 1/2019 |
| WO | 2008/120086 | A2 | 10/2008 |

* cited by examiner

LIQUID INJECTION NOZZLE

FIELD OF THE INVENTION

The present invention relates to a liquid injection nozzle for injecting liquid such as fuel, which is used in various types of apparatuses, for example, an engine, a combustor, and an exhaust gas purification apparatus.

BACKGROUND OF THE INVENTION

Conventionally, a liquid injection apparatus that injects liquid such as fuel or ammonia water is used in, for example, an engine, a combustor, and an exhaust gas purification apparatus. In the liquid injection apparatus, reserved high-pressure liquid is fed to a nozzle portion, and a valve needle in the nozzle portion is released from a valve seat so as to inject the high-pressure liquid into a chamber such as a liquid spraying chamber or a combustion chamber, whereby the liquid is sprayed. For example, since a common rail fuel injection apparatus can perform multi-stage injection of fuel at 2,000 bar or higher, the common rail fuel injection apparatus is employed in the latest engines. The biggest drawback of the liquid injection apparatus associated with its liquid injection system is high cost; i.e., high cost of components of the injection system. It has been said that this is one cause which prevents spreading of the liquid injection apparatus.

A fuel injection nozzle which promotes atomization of spray while maintaining the strength of an injection hole plate has been known (see, for example. Japanese Patent Application Laid-Open No. 2004-84549). In the fuel injection nozzle, an injection hole is formed in the injection hole plate, which is attached to a tip of a nozzle body. The injection hole plate has a recess formed along the circumferential edge of an inlet side opening of the injection hole, whereby the thickness of the injection hole plate in the vicinity of the injection hole is reduced, and the overall length of the injection hole is shortened. Since fuel flows along the recess into the injection hole, the position where collision of the fuel occurs becomes closer to the outlet side of the injection hole. Thus, the fuel whose flow has been disturbed at a position closer to the outlet side is less likely to be rectified by the shortened injection hole. Therefore, atomization of spray of the fuel is promoted.

Also, a variable injection nozzle type fuel injection nozzle has been known (see, for example, Japanese Patent Application Laid-Open No. 2006-220129). In the fuel injection nozzle, in order to open and close a second injection hole, an outer needle has a second outer seat portion provided closer to the distal end side than a through hole, and further, a circumferential groove is provided on the distal end side of the second outer seat portion. It becomes easier for a portion in the vicinity of the second outer seat portion to elastically deform due to urging force stemming from back pressure or the like. The second outer seat portion is strongly pressed against a second outer seat surface, whereby communication between an outer reservoir portion and the second injection hole is cut off without fail.

Incidentally, the present applicant has developed a multi-injection-hole structure for a liquid injection nozzle and has filed a patent application therefor (see, for example, Japanese Patent Application Laid-Open No. 2019-15253). The liquid injection nozzle atomizes liquid and sprays the atomized liquid, whereby mixing between the sprayed liquid and a gas is promoted, and reaction between the liquid and the gas is promoted. In the liquid injection nozzle, a plurality of distal end tips having injection holes formed therein are disposed on a distal end portion of a nozzle body. In each distal end tip, a swirling flow chamber is formed around the injection hole, and thin holes are formed in the distal end portion in such a manner that the thin holes extend from an inner wall surface of a hollow chamber, which inner wall surface is located on a distal end side of a valve seat, to a peripheral region of the swirling flow chamber of the distal end tip, so that the liquid flows into the swirling flow chamber in the tangential direction. When the valve needle is lifted, the liquid in a liquid passage flows from the thin holes into the swirling flow chamber in the tangential direction, whereby a swirling flow is generated. The swirling flow is sprayed form the injection hole into the external space. Notably, the term "tangential direction" used herein means a direction parallel to an imaginary line tangent to a circular cross section of the swirling flow chamber taken perpendicular to the center axis of the swirling flow chamber.

Incidentally, in the conventional liquid injection apparatus, liquid injected from the nozzle cannot be atomized to a sufficient degree. Therefore, the injected liquid cannot be diffused to a sufficient degree in a chamber, and therefore, the state of mixing between air and fuel or the state of mixing between exhaust gas and liquid such as ammonia water or urea water used for exhaust gas purification has not been satisfactory.

In view of this, as described above, the present applicant has developed, as an injection hole structure for a liquid injection nozzle, a liquid injection nozzle which is composed of three layer plates having respective flow passages formed therein, and in which liquid flows through the flow passages of the three layer plates one after another, whereby a swirling flow is generated in the liquid. The liquid injection nozzle atomizes the liquid and sprays the atomized liquid, whereby mixing between the liquid and a gas is promoted, and the reaction between the liquid and the gas is promoted. However, since the swirling flow chamber formed in each distal end tip portion has a disk-like shape and the wall on the outlet side is flat, the following problem occurs. The communication thin holes formed in the distal end portion incline about 20 degrees in relation to the axis of the swirling flow chamber. Therefore, the liquid flows while changing its flow direction by an angle of 70 degrees and then forms a swirling flow. Therefore, in the above-described liquid injection nozzle, the kinetic energy of the swirling flow (i.e., vortex flow) generated in the swirling flow chamber is lost greatly when the liquid flows from the disk-shaped swirling flow chamber into the injection hole. Furthermore, since the vortex flow generated in the disk-shaped swirling flow chamber flows into the injection hole at the center of the disk-shaped swirling flow chamber, the liquid flows into the flow channel of the injection hole while again changing its flow direction by 90 degrees. Therefore, great loss of the kinetic energy occurs at that time. In the above-described liquid injection nozzle, when the valve needle is lifted, the liquid in a liquid passage flows through the thin holes and flows tangentially into the swirling flow chamber, thereby generating a vortex flow; i.e., swirling flow. However, the kinetic energy of the swirling flow is greatly lost, and a swirling flow having a reduced kinetic energy is sprayed from the injection hole into the external space. Therefore, the above-described liquid injection nozzle can not spray liquid in such a manner that the sprayed liquid spreads greatly in the external space and cannot spray liquid at an increased flow rate.

SUMMARY OF THE INVENTION

An object of the present invention is to provide an improved liquid injection nozzle which solves the above-described problem. Specifically, in order to further improve the liquid injection nozzle disclosed in the prior application, the improved liquid injection nozzle has the following characteristic features. The swirling flow chamber formed in each distal end tip disposed on a distal end portion of a nozzle body has a conical surface (specifically, truncated conical surface). Thus, liquid in a liquid reserving chamber of the nozzle body is led to the swirling flow chamber through a communication thin hole, and a strong vortex flow is generated in the swirling flow chamber. Without reducing the kinetic energy of the vortex flow, in a state in which the swirling of the vortex flow has been promoted, the liquid is strongly sprayed from the injection hole in such a manner that the liquid spreads widely and the liquid is sprayed at an increased flow rate. As a result, mixing between the liquid and a gas such as air or combustion gas is promoted, whereby combustion or the like is promoted.

SUBJECT TO BE SOLVED WITH THE PRESENT INVENTION

A liquid injection nozzle of the present invention comprises:

a nozzle body including a liquid passage having a liquid reserving chamber for supplying liquid; and a valve needle which is reciprocatably inserted into a hollow chamber formed in the nozzle body and extending in a longitudinal direction, wherein a distal end of the valve needle is seated on a valve seat portion formed on a distal-end-side wall surface of the hollow chamber of the nozzle body:

wherein a distal end liquid reserving chamber is formed on a distal end side of the valve seat portion, wherein a plurality of injection holes are formed on a wall surface of the distal end liquid reserving chamber; and when the valve needle is lifted, a liquid passage formed between the distal-end-side wall surface of the hollow chamber of the nozzle body and an outer circumferential surface of the distal end of the valve needle is opened, and the liquid is sprayed from the injection holes into an external space, wherein a plurality of distal end tips having the injection holes formed therein are provided on a distal end portion of the nozzle body in such a manner that the distal end tips are spaced from one another in a circumferential direction:

wherein each of the distal end tips has a swirling flow chamber formed on an inner side of the distal end tip and having a conical shape, and the injection hole formed on an outer side of the distal end tip and communicating with the swirling flow chamber, at least one communication thin hole for establishing communication between the distal end liquid reserving chamber and the swirling flow chamber is formed in the distal end portion of the nozzle body, the communication thin hole having an inclination in relation to an axis of the swirling flow chamber, the inclination having a component in an axial direction of the injection hole and a component in a tangential direction of the swirling flow chamber: and when the valve needle is lifted, the liquid in the liquid passage flows through the communication thin hole into the swirling flow chamber and generates a vortex flow in the swirling flow chamber, and the vortex flow is sprayed from the injection hole into the external space.

The communication thin hole may have an inclination angle of 15 degrees to 45 degrees in relation to the axis of the swirling flow chamber. The conical swirling flow chamber may be formed in such a manner that its conical wall surface inclines at an angle of 10 degrees to 40 degrees in relation to the axis of the swirling flow chamber so that the diameter of the swirling flow chamber increases toward a side where the liquid flows into the swirling flow chamber. Further, the axis of the injection hole may be located eccentrically with respect to the axis of the swirling flow chamber. Alternatively, the axis of the injection hole may be located on the axis of the swirling flow chamber.

Each of the distal end tips may be joined to a through hole formed in the distal end portion of the nozzle body.

The liquid injection nozzle may have two communication thin holes which are formed in the distal end portion of the nozzle body for each of the distal end tip. The two communication thin holes are formed at predetermined different positions in opposition to the conical surface of the swirling flow chamber in such a manner that the communication thin holes extend obliquely in relation to the tangential direction and obliquely in relation to each other, so that the liquid jetted from one of the communication thin holes and the liquid jetted from the other communication thin hole form vortex flows in the same direction within the swirling flow chamber.

Alternatively, the liquid injection nozzle may have two communication thin holes which are formed in the distal end portion of the nozzle body for each of the distal end tip, and the swirling flow chamber may be a complex swirl flow chamber composed of a cylindrical chamber and a conical chamber extending continuously from the cylindrical chamber.

The liquid may be fuel for a super-high pressure type diesel engine.

Effects of the Invention

The liquid injection nozzle of the present invention is configured as described above. Specifically, the swirling flow chamber formed in each of the distal end tips provided on the nozzle body is defined by a conical surface. Therefore, liquid in the liquid reserving chamber flows through the communication thin hole into the swirling flow chamber at high speed along the conical surface. The liquid flows from the swirling flow chamber to the injection hole without changing its flow direction: i.e., without losing the kinetic energy of the liquid. Namely, loss of the kinetic energy is minimized by the flow of vortex flow from the swirling flow chamber to the injection hole. Within the conical swirling flow chamber, the rotating vortex flow flows along the conical surface toward a distal end portion of the conical swirling flow chamber while reducing its rotation diameter, thereby increasing its rotation speed. The high speed vortex flow is sprayed from the injection hole without changing its flow direction. By virtue of this configuration, loss of the kinetic energy of the liquid due to contracted flow of the vortex flow within the swirling flow chamber can be reduced greatly, and it becomes possible to increase the flow rate of the liquid. The kinetic energy of the liquid in the communication thin hole is smoothly converted to the kinetic energy of the vortex flow within the swirling flow chamber, and the liquid can flow to the injection hole with the smallest loss of the kinetic energy of the liquid. As a result, unlike the conventional disk-shaped swirling flow chamber, the conical swirling flow chamber of the present invention makes it possible to spray the liquid from the injection hole without reducing the kinetic energy of the liquid. The conical surface of the swirling flow chamber has an inclination angle of 10 degrees to 40 degrees in relation to the axis (i.e., the conical swirling flow chamber has an open angle of 20 degrees to 80 degrees). Preferably, the conical surface of the swirling flow chamber has an inclination angle of about 15 degrees in relation to the axis (i.e., the conical swirling flow chamber has an open angle of about 30 degrees). In other words, if the inclination angle is the same as the inclination angle of the communication thin hole in the conical swirling flow chamber, through formation of the conical swirling flow chamber, the spreading angle of spray (the degree of diffusion) can be increased. This makes it possible to decrease the diameter of the bottom surface of the conical swirling flow chamber, thereby greatly reducing the dead volume of the flow passage.

In the case of the disk-shaped swirling flow chamber, the communication thin hole through which the liquid flows into the disk-shaped swirling flow chamber has an inclination angle of 20 degrees in relation to the center axis (i.e., axis) of the disk-shaped swirling flow chamber, and, due to this inclination, the flow direction of inflow liquid (i.e., inflow fuel) can be split into a component parallel to an axial flow direction: i.e., the center axis of the disk-shaped swirling flow chamber, and a component which is perpendicular to the center axis and is parallel to the tangential direction of the disk-shaped swirling flow chamber. Due to the flow in the direction perpendicular to the center axis of the disk-shaped swirling flow chamber, a strong vortex is generated in the swirling flow chamber. In contrast, in the case of the conical swirling flow chamber, the liquid (fuel) having passed through the communication thin hole obliquely flows into the conical swirling flow chamber along the conical surface. Therefore, loss of the kinetic energy of the liquid is small. As a result, in the case of the disk-shaped swirling flow chamber employed in the liquid injection nozzle disclosed in the prior application, the most appropriate inclination of the communication thin hole of the nozzle body in relation to the center axis of the swirling flow chamber was 25 degrees to 30 degrees. In contrast, in the case of the conical swirling flow chamber employed in the present invention, the most appropriate inclination of the communication thin hole of the nozzle body in relation to the center axis of the swirling flow chamber is 15 degrees to 30 degrees. If the inclination angle of the communication thin hole is excessively large, the communication thin hole fails to communicate with a liquid (oil) reserving chamber of the nozzle, which chamber has a diameter of about 0.8 to 1 mm. In the case where the diameter of the liquid reserving chamber is increased so as to enable the communication thin hole to communicate with the liquid reserving chamber, the dead volume in the nozzle increases. However, this is not preferable, because an increase in the dead volume in the nozzle leads to an increase in the generation amount of HC, etc. Further, since the liquid smoothly flows from the communication thin hole into the conical swirling flow chamber, the pressure applied to the liquid by a high-pressure injection pump acts on the sprayed liquid without involvement of loss of the pressure. Namely, when the same inclination angle as the communication thin hole in the case of the disk-shaped swirling flow chamber is employed, the spreading angle of spray can be increased through use of the conical swirling flow chamber. Therefore, the diameter of the bottom surface of the conical swirling flow chamber can be decreased, which contributes to a great reduction in the dead volume of the liquid (oil) passage.

By virtue of the above, in this liquid injection nozzle, when the liquid (i.e., fuel) is sprayed from the injection hole through the conical swirling flow chamber, a strong vortex flow can be formed without loss of the kinetic energy of the liquid, whereby the liquid is sprayed from the injection hole in such a manner that the liquid is diffused. The liquid flowing through the communication thin hole forms a vortex flow in the conical swirling flow chamber, and the vortex flow flows into the injection hole without loss of kinetic energy. Namely, the loss of kinetic energy when the liquid flows from the conical swirling flow chamber to the injection hole decreases, and the dead volume of the conical swirling flow chamber becomes approximately one third. Also, the inclination of the communication thin hole through which the liquid flows into the swirling flow chamber can be reduced to about a half of the inclination necessary for generation of a necessary vortex flow, and manufacture of the distal end tips becomes easier. Also, when the liquid is sprayed from the injection hole to obtain a spray having the same spreading angle, as compared with the disk-shaped swirling flow chamber, the conical swirling flow chamber can increase the flow rate of the liquid. In the case of the present liquid injection nozzle, even when the number of communication thin holes formed in the distal end portion and communicating with the swirling flow chamber is reduced to one, the shape, degree of spreading, particle size, and length of the spray do not change, production cost can be reduced, and the strength of the distal end tips provided on the distal end portion of the nozzle body can be increased. Namely, in the present liquid injection nozzle, a swirling flow of liquid, such as fuel, ammonia water, or urea water, having strong kinetic energy is formed in the conical swirling flow chamber, and the liquid is atomized and sprayed from the injection hole so as to diffuse the atomized liquid. As a result, mixing between the sprayed liquid and a gas such as air or exhaust gas is promoted, whereby combustion or oxidation-reduction reaction can be promoted. Namely, in each of the distal end tips, the conical surface of the swirling flow chamber changes the flow of the liquid to a vortex flow and leads the vortex flow to the injection hole while maintaining its kinetic energy. As a result, the atomization of the liquid sprayed from the injection hole is promoted, and the liquid is sprayed and diffused in a wide area in such a manner that the spreading angle of the liquid becomes large.

BRIEF DESCRIPTION OF THE DRAWING

FIGS. 2(A) and 2(B) are view showing a region of FIG. 1 indicated by symbol C, wherein FIG. 2(A) is an enlarged sectional view, and FIG. 2(B) is a front view as viewed in a direction indicated by symbol D in FIG. 2(A).

FIGS. 8(A). 8(B), and 8(C) are views of a fourth embodiment of the liquid injection nozzle of the present invention showing the positional relation among a single communication thin hole formed in the distal end portion of the nozzle body and a swirling flow chamber and an injection hole formed in a corresponding one of the distal end tips, wherein FIG. 8(A) shows that the axis of the swirling flow chamber coincides with the axis of the injection hole.

FIGS. 9(A) and 9(B) are views of a fifth embodiment of the liquid injection nozzle of the present invention showing the positional relation among a single communication thin hole formed in the distal end portion of the nozzle body and a swirling flow chamber and an injection hole formed in a corresponding one of the distal end tips, wherein FIG. 9(A) shows that the axis of the swirling flow chamber and the axis of the injection hole are eccentric in relation to each other, and FIG. 9(B) is an explanatory plan view of the communication thin hole, the swirling flow chamber, and the injection hole shown in FIG. 9(A).

FIGS. 10(A). 10(B), and 10(C) are views of a sixth embodiment of the liquid injection nozzle of the present invention showing the positional relation among two communication thin holes formed in the distal end portion of the nozzle body and a swirling flow chamber a end an injection hole formed in a corresponding one of the distal end tip, wherein FIG. 10(A) shows that the two communication thin holes eccentrically communicate with the swirling flow chamber and the axis of the swirling flow chamber coincides with the axis of the injection hole.

FIGS. 11(A), 11(B), and 11(C) are views of a seventh embodiment of the liquid injection nozzle of the present invention showing the positional relation among two communication thin holes formed in the distal end portion of the nozzle body and a complex swirling flow chamber and an injection hole formed in a corresponding one of the distal end tips, wherein FIG. 11(A) shows that the two communication thin holes eccentrically communicate with the complex swirling flow chamber and that the axis of the complex swirling flow chamber coincides with the axis of the injection hole, FIG. 11(B) is an explanatory side view of the communication thin holes, the complex swirling flow chamber, and the injection hole shown in FIG. 11(A) as viewed from a circumferential position shifted 90 degrees from the circumferential position of the side view of FIG. 11(A), and FIG. 11(C) is an explanatory plan view of the communication thin holes, the complex swirling flow chamber, and the injection hole shown in FIG. 11(B).

DETAILED DESCRIPTION OF THE EMBODIMENTS

Figure 1:
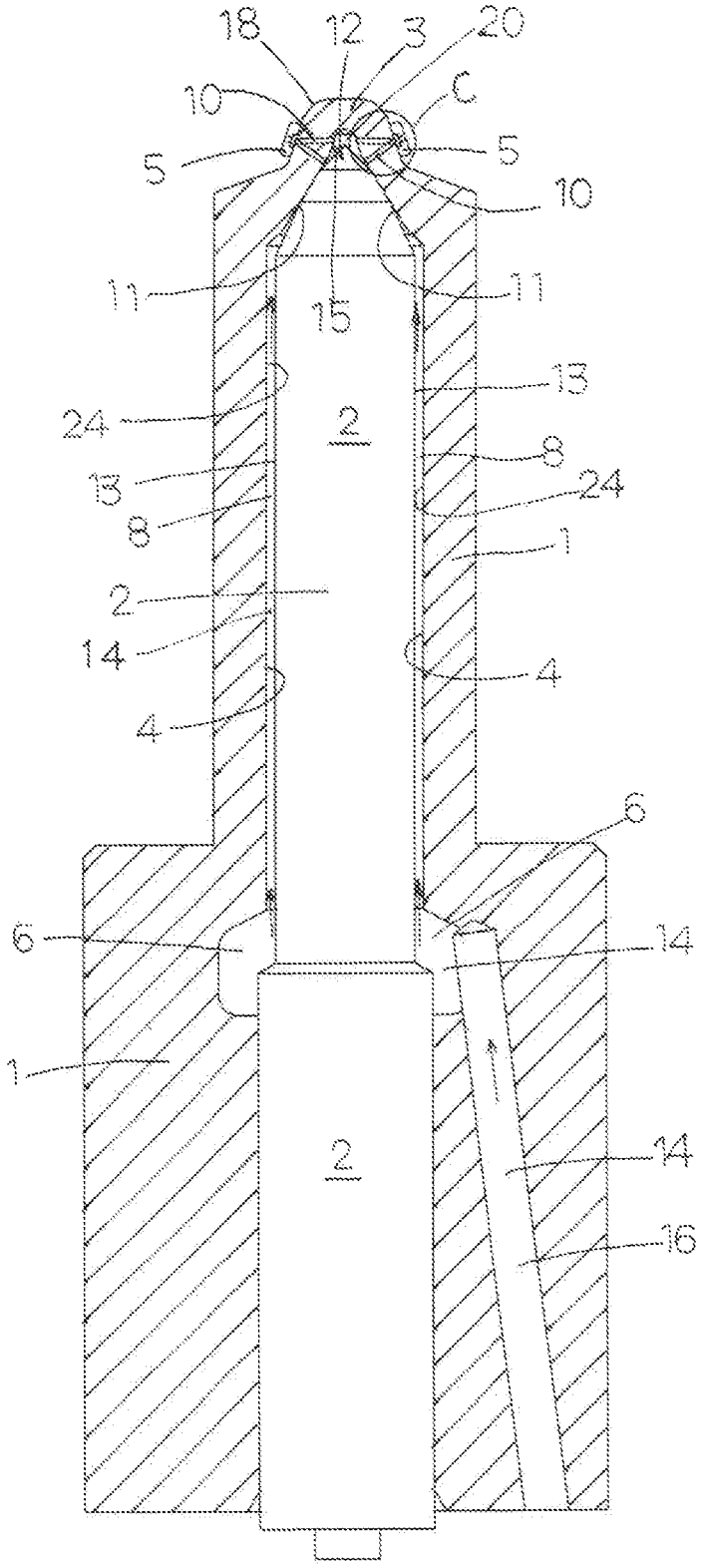
FIG. 1 is a schematic sectional view of a first embodiment of a liquid injection nozzle according to the present invention, the sectional view showing a multi-injection-hole structure provided on a distal end portion of a nozzle body, wherein two distal end tips are shown, and two communication thin holes are formed in the distal end portion of the nozzle body for each distal end tip.

It is preferred that the multi-injection-hole structure of the liquid injection nozzle according to the present invention be applied, for example, to a liquid spraying nozzle such as a fuel injection apparatus mounted on a diesel engine, or an exhaust gas purification apparatus which sprays liquid such as ammonia water or urea water.

Embodiments of the liquid injection nozzle will now be described with reference to the drawings. First, the structure of a first embodiment of the liquid injection nozzle will be roughly described with reference to FIGS. 1 and 2. This liquid injection nozzle can be applied, for example, to a fuel injection nozzle mounted on a diesel engine or a gasoline engine, or an exhaust gas purification apparatus which sprays liquid such as ammonia water or urea water. The liquid injection nozzle includes, as main components, a pipe-shaped nozzle body 1 which is fixed to a mounting portion of an engine, an injection apparatus, a combustion apparatus, or the like and having liquid passages 8 and 16 for supplying liquid; and a valve needle 2 which serves as a valve element and which is slidably inserted into a longitudinally extending hollow chamber 4 of the nozzle body 1 and forming a liquid reserving chamber 6. The injection hole structure of the liquid injection nozzle is generally characterized by the structure of a distal end portion 3 of the nozzle body 1. The nozzle body 1 is composed of a metal pipe having the hollow chamber 4 extending therethrough while maintaining a fixed diameter. A hollow chamber 20 having a reduced diameter is formed in the distal end portion 3. The hollow chamber 20 serves as a distal end liquid reserving chamber. The liquid injection nozzle has a tapered valve seat 11 formed on a distal-end-side side wall surface 15 of the hollow chamber 4 of the nozzle body 1. A conical distal end surface 12 of the valve needle 2 is seated on the valve seat 11. When the valve needle 2 is lifted, a liquid passage 8 formed between the wall surface 24 of the hollow chamber 4 of the nozzle body 1 and an outer circumferential surface 13 of the valve needle 2 is opened, whereby the liquid is sprayed from a plurality of injection holes 7 provided in the distal end portion 3 of the nozzle body 1. In particular, it is preferred that the liquid injection nozzle having a multi-injection-hole structure be applied to super-high pressure type fuel injection nozzles for diesel engines whose injection pressure is high (for example, about 100 to 300 Mpa) and whose liquid spraying speed reaches about 1000 m/s. Also, since direct injection gasoline engines require atomization of fuel, this multi-injection-hole structure can be applied to high pressure fuel injection nozzles for gasoline engines.

The multi-injection-hole structure constituting the liquid injection nozzle includes a plurality of (six in the drawings) distal end tips 5. The distal end tips 5 may be machined to be integral with the distal end portion 3 of the nozzle body 1. Alternatively, the distal end tips 5 may be joined to the distal end portion 3 of the nozzle body 1 in such a manner that the distal end tips 5 are spaced from one another in the circumferential direction of the distal end portion 3. In FIGS. 1 and 2, the distal end tips 5 protrude from the outer surface of the nozzle body 1. However, needless to say, the distal end tips 5 may be disposed in recessed portions of the nozzle body 1 in an embedded condition. In the injection hole structure, a plurality of, preferably, six distal end tips 5 are disposed on the distal end portion 3 of the nozzle body 1 in such a manner that the distal end tips 5 are spaced from one another in the circumferential direction: however, 4, 5, 7, or 12 distal end tips 5 may be provided, depending on the size and type of the liquid injection nozzle. A truncated conical liquid reservoir defined by a conical surface 25 is formed in each distal end tip 5 and is used as a swirling flow chamber 9. For each distal end tip 5, at least one (preferably, two) communication thin hole 10 (in FIG. 1, two communication thin holes 10) serving as a passage is formed in the distal end portion 3 of the nozzle body 1. In the present embodiment, two communication thin holes 10 are formed in the distal end portion 3 of the nozzle body 1 for the swirling flow chamber 9 of a corresponding one of the distal end tips 5 in such a manner that the communication thin holes 10 are staggered each other. The communication thin holes 10 have a diameter of, for example, about 0.1 mm. As shown in FIGS. 1 and 2, the communication thin holes 10 formed in the distal end portion 3 extend obliquely in relation to the tangential direction of the swirling flow chamber 9 and communicate with a peripheral region 17 of the swirling flow chamber 9. Liquid (hereinafter referred to as flue 14 as an example) is caused to flow through the two communication thin holes 10 into the swirling flow chamber 9, serving as a liquid reservoir, in a staggered manner, whereby a vortex flow (i.e., a swirling flow) is generated in the swirling flow chamber 9, and the flue 14 is sprayed to an external space such as a combustion chamber. In the external combustion chamber (not shown), a spray of the fuel 14 collides with air whose pressure is high normally, whereby shearing force acts on the fuel 14, whereby atomization of the fuel 14 is promoted. The fuel 14 may be various types of light oils used for super-high pressure type diesel engines or various types of gasolines used for gasoline engines.

The liquid injection nozzle is characterized particularly in that, in addition to the above-mentioned shearing force, the swirling flow acts on the fuel 14, whereby centrifugal force is generated, and atomization of the fuel 14 is promoted further. In the case of the liquid injection nozzle, when a vortex flow of the spray of the fuel 14 is strongly injected into a combustion chamber from the injection hole 7, the spray spreads widely within the combustion chamber. Namely, the fuel 14 is injected in a preferred condition. In particular, since the swirling flow chamber 9 having a truncated conical shape is defined by the conical surface 25, the fuel 14 having flowed into the swirling flow chamber 9 smoothly flows along the conical surface 25 and forms a vortex flow without losing its kinetic energy. When the eccentric radius of the communication thin holes 10 through which the fuel 14 flows into the swirling flow chamber 9 is large, the vortex flow becomes stronger. The eccentric radius means a distance r between the axis 26 of the swirling flow chamber 9 and a point where the fuel 14 flows into the swirling flow chamber 9; i.e., the axis 21 of the communication thin hole 10 (see FIG. 8(B)). When the unit mass of the fuel 14 flowing into the swirling flow chamber 9 is represented by m and the moment of inertia is represented by I, a relation of I=mr2 holds. When the angular velocity of the rotating fuel 14 is represented by ω, the kinetic energy of the rotating fuel 14 is represented by (1/2)mr2ω2. Accordingly, when the eccentric radius r is large, the kinetic energy of the rotating fuel 14 increases, and the vortex flow becomes stronger. Further, when the angular velocity ω, which is the flow velocity of the fuel 14 flowing from each communication thin hole 10 into the swirling flow chamber 9 is large, the vortex flow becomes stronger and is promoted. The flow velocity is determined by the diameter of the communication thin holes 10, and the kinetic energy is represented by (1/2)mV2. Also, in this multi-injection-hole structure, boundary regions between the communication thin holes 10 and the swirling flow chamber 9 are machined smoothly, whereby pressure loss is reduced.

The most appropriate inclination angle of each communication thin hole 10 of the nozzle body 1 in relation to the center axis (i.e., the axis) of the swirling flow chamber was 25 degrees to 30 degrees in the case of the liquid injection nozzle disclosed in the prior application and having disk-shaped swirling flow chambers, and was 15 degrees to 30 degrees in the case of the liquid injection nozzle of the present invention and having the conical swirling flow chambers 9. When the inclination angle of each communication thin hole 10 is excessively large, the communication thin hole 10 fails to communicate with the liquid (fuel) reserving chamber of the nozzle, which chamber has a diameter of about 0.8 to 1 mm. In the case where the diameter of the liquid reserving chamber 20 is increased so as to enable the communication thin hole 10 to communicate with the liquid reserving chamber 20, the dead volume in the nozzle increases. However, this is not preferable, because an increase in the dead volume in the nozzle leads to an increase in the generation amount of HC, etc. Further, since the liquid 14 smoothly flows from the communication thin hole 10 into the conical swirling flow chamber 9, the pressure applied to the liquid by a high-pressure injection pump acts on the sprayed liquid without involvement of loss of the pressure. Namely, in the present liquid injection nozzle, the inclination angle of each communication thin hole 10 in relation to the axis 26 of the swirling flow chamber 9 is preferably 15 degrees to 30 degrees.

Also, in the liquid injection nozzle of the present invention, the conical swirling flow chamber 9 formed in each distal end tip 5 is defined by a funnel-shaped, truncated conical surface 25, which is open on the side where the liquid 14 flows in the swirling flow chamber 9 and which has an angle of 10 degrees to 40 degrees in relation to the axis 26 of the swirling flow chamber 9. As a result, the cross sectional area of the swirling flow chamber 9 decreases on the side where the liquid flows out from the swirling flow chamber 9 and flows into the injection hole 7. It has been found that the above-described configuration is effective because the liquid 14 flows strongly and smoothly from the swirling flow chamber 9 into the injection hole 7 in the form of a vortex flow.

Figure 2A:
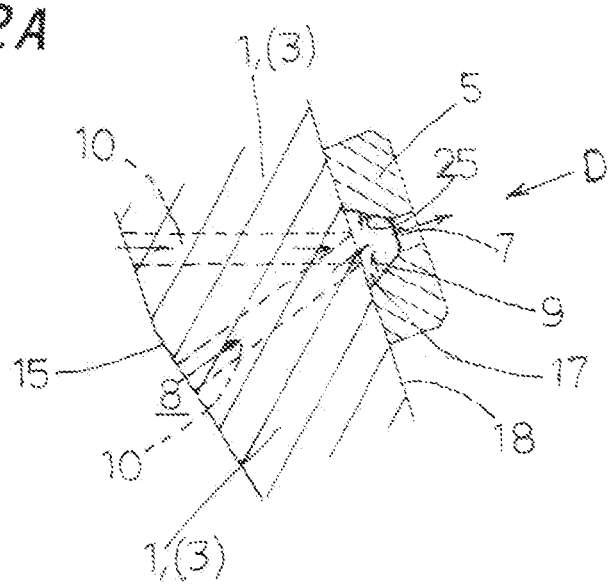
Figure 2B:
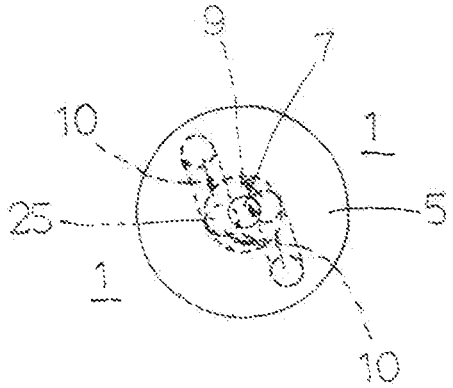

The multi-injection-hole structures of embodiments of the liquid injection nozzle will be described with reference to FIGS. 1 to 7. The multi-injection-hole structures of the embodiments are characterized in that a plurality of (for example, 6) distal end tips 5 each having a single injection hole 7 are provided on the outer surface 18 of the distal end portion 3 of the nozzle body 1 in such a manner that the distal end tips 5 are spaced from one another in the circumferential direction, and each distal end tip 5 has a swirling flow chamber 9 which is formed inside the distal end tip 5 and is defined by the conical surface 25 around the injection hole 7. FIGS. 1, 2(A) and 2(B) show the multi-injection-hole structure of the first embodiment of the liquid injection nozzle. In FIGS. 2(A) and 2(B) showing the first embodiment, the flow direction of the fuel 14 is shown by arrows. The wall surface of the swirling flow chamber 9 formed in the back side of the distal end tip 5 is the conical surface 25. Therefore, the wall surface does not resist the flow of the fuel 14. In this multi-injection-hole structure, for each distal end chip 5, at least one (two in the drawings) communication thin hole 10 is formed in the distal end portion 3 of the nozzle body 1 in a staggered manner. The communication thin holes 10 extend from the wall surface 15 of the hollow chamber 4 located on the distal end side of the valve seat 11 to a peripheral region 17 of the swirling flow chamber 9 of the distal end tip 5 in the tangential direction, thereby communicating with the swirling flow chamber 9. Furthermore, this multi-injection-hole structure is characterized in that, when the valve needle 2 is lifted, the fuel 14 in the liquid passage 8 flows through the communication thin holes 10 into the peripheral region 17 of the corresponding swirling flow chamber 9 in the tangential direction and generates a conical vortex flow in the swirling flow chamber 9, and the vortex flow is sprayed from the corresponding injection hole 7 to the external space. Also, it is preferred that at least one communication thin hole 10 be formed for each distal end tip 5. In the case where a plurality of communication thin holes 10 are formed for each distal end tip 5, the communication thin holes 10 are formed in the distal end portion 3 of the nozzle body 1 in such a manner that the communication thin holes 10 extend to predetermined positions for the peripheral region 17 of the swirling flow chamber 9; i.e., at different angular positions in opposition to the peripheral region 17, so that the fuel 14 obliquely flows in the peripheral region 17 in the tangential direction. Namely, since the fuel 14 flows from the communication thin holes 10 into the swirling flow chamber 9 having the conical surface 25, a vortex flow is generated in the swirling flow chamber 9, whereby pressure loss decreases. The fuel 14, which forms a vortex flow in the swirling flow chamber 9, is then sprayed from the injection hole 7 into an external combustion chamber. The sprayed fuel spreads widely and is atomized, whereby mixing between the fuel and air in the combustion chamber or exhaust gas is promoted.

Figure 3:
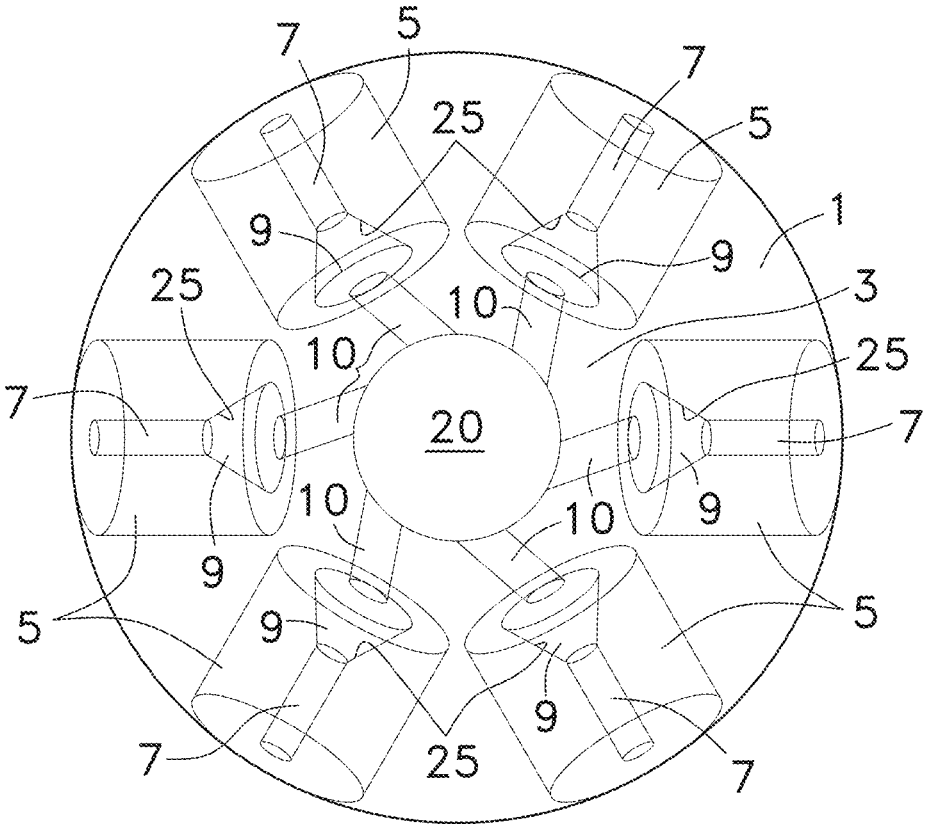
FIG. 3 is a see-through front view of six distal end tips in the multi-injection-hole structure of a second embodiment of the liquid injection nozzle of the present invention, as viewed from the distal end side, for the case where a single communication thin hole is formed in the distal end portion of the nozzle body for each distal end tip, the view being an explanatory view showing three-dimensionally an injection hole and a swirling flow chamber formed in each distal end tip.
Figure 4:
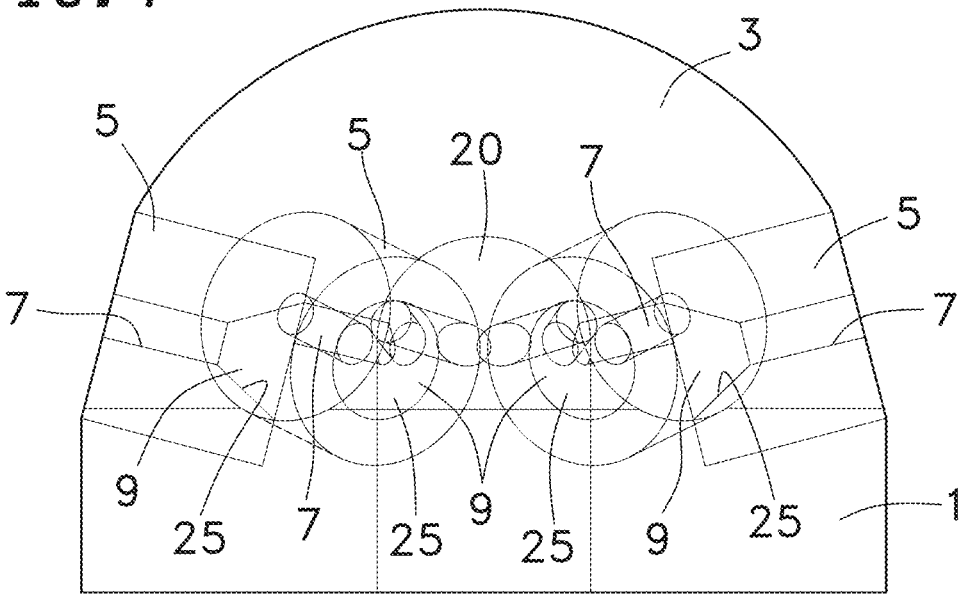
FIG. 4 is a side view showing the distal end portion of the nozzle body of FIG. 3.
Figure 5:
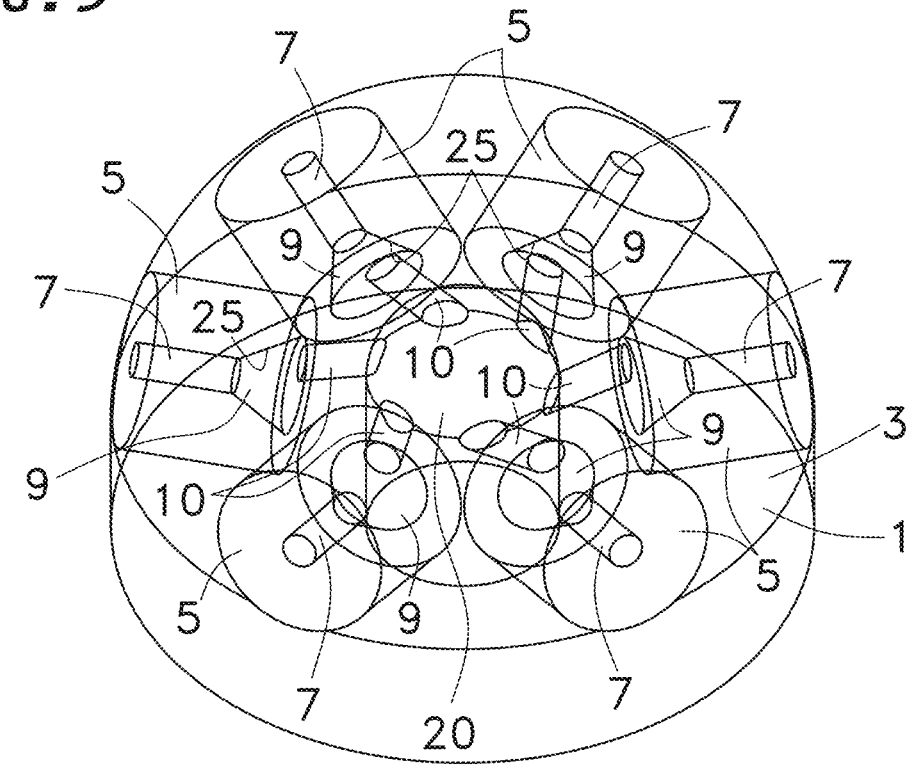
FIG. 5 is a see-through perspective view of six distal end tips in the multi-injection-hole structure of the second embodiment of the liquid injection nozzle of the present invention, as viewed from the distal end side, for the case where a single communication thin hole is formed in the distal end portion of the nozzle body for each distal end tip, the view being an explanatory view showing three-dimensionally the injection hole and the swirling flow chamber formed in each distal end tip.
Figure 6:
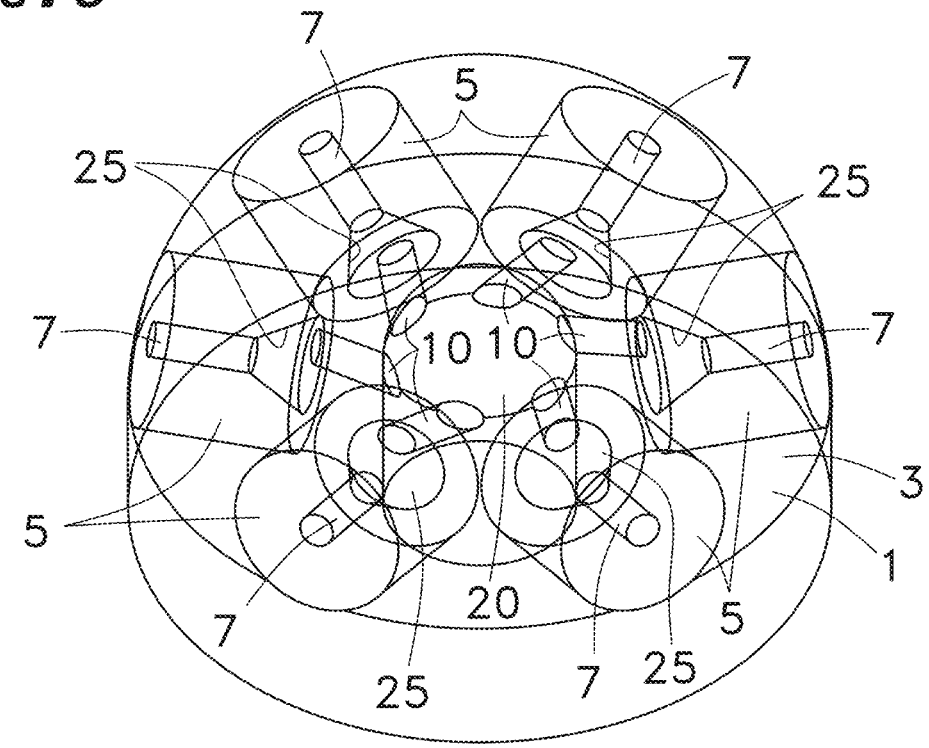
FIG. 6 is a see-through perspective view showing the case where the communication thin holes formed in the distal end portion of the nozzle body are inclined in the direction opposite the direction in which the communication thin holes are inclined in the multi-injection-hole structure of the fuel injection nozzle of FIG. 5.

Next, the multi-injection-hole structure of a second embodiment of the liquid injection nozzle will be described with reference to FIGS. 3 to 6. FIG. 3 shows a see-through front view of six distal end tips 5, as viewed from the front end side, in the multi-injection-hole structure of the second embodiment of the liquid injection nozzle of the present invention. A single communication thin hole 10 is formed in the distal end portion 3 of the nozzle body 1 for each distal end tip 5. In FIG. 3, an injection hole 7 and a swirling flow chamber 9 formed in each distal end tip 5 are shown three-dimensionally. FIG. 4 is a side view showing the distal end portion 3 of the nozzle body 1 of FIG. 3. FIG. 5 is a see-through perspective view of the six distal end tips 5 in the multi-injection-hole structure shown in FIG. 3. FIG. 5 shows the case where a single communication thin hole 10 is formed in the distal end portion 3 of the nozzle body 1. In FIG. 5, the injection hole 7 and the swirling flow chamber 9 formed in each distal end tip 5 are shown three-dimensionally. FIG. 6 shows the case where the communication thin holes 10 formed in the distal end portion 3 of the nozzle body 1 are inclined in the direction opposite the direction in which the communication thin holes 10 are inclined in the multi-injection-hole structure of the fuel injection nozzle of FIG. 5. In FIG. 6, the injection hole 7 and the swirling flow chamber 9 formed in each distal end tip 5 are shown three-dimensionally.

Figure 7:
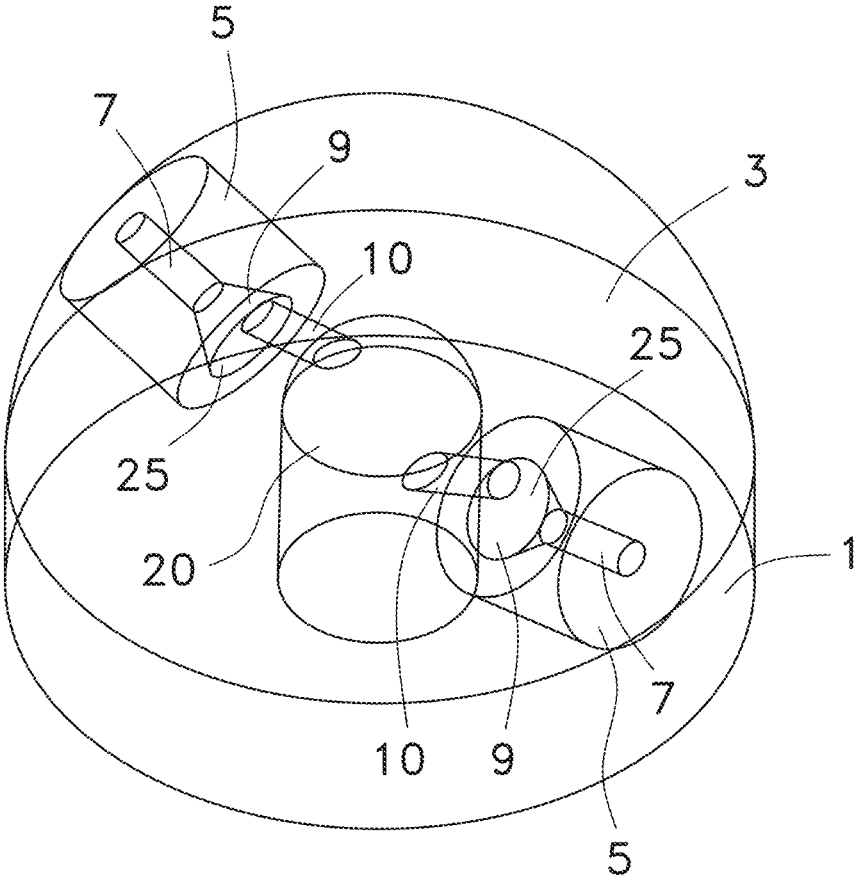
FIG. 7 is a see-through perspective view of two distal end tips in the multi-injection-hole structure of a third embodiment of the liquid injection nozzle of the present invention, as viewed from the distal end side, for the case where a single communication thin hole is formed in the distal end portion of the nozzle body for each distal end tip, the view being an explanatory view showing three-dimensionally the injection hole and the swirling flow chamber formed in each distal end tip.

Next, the multi-injection-hole structure of a third embodiment of the liquid injection nozzle will be described with reference to FIG. 7. FIG. 7 shows a see-through perspective view of the multi-injection-hole structure of the liquid injection nozzle of the present invention as viewed from the distal end side. FIG. 7 shows a see-through perspective view of the multi-injection-hole structure in which two distal end tips 5 are attached to the distal end portion 3 of the nozzle body 1. FIG. 7 shows the case where a single communication thin hole is formed in the distal end portion 3. In FIG. 7, the injection hole 7 and the swirling flow chamber 9 formed in each distal end tip 5 are shown three-dimensionally.

As described above, each of FIGS. 3 to 7 generally shows a see-through view of the distal end portion 3 of the nozzle body 1 for description of the distal end tips 5 and the communication thin holes 10, which are hollow spaces. Specifically, in these drawings, the outer shapes of the communication thin holes 10 and the distal end tips 5 are shown three-dimensionally, and a see-through view of the distal end portion 3 is shown. The multi-injection-hole structures of these embodiments are characterized in particular in that a plurality of (six in FIGS. 3 to 6, and two in FIG. 7) distal end tips 5 each having a single injection hole 7 are provided on the outer surface 18 of the distal end portion 3 of the nozzle body 1 in such a manner that the distal end tips 5 are spaced from one another in the circumferential direction: a truncated conical swirling flow chamber 9 is formed in each distal end tip 5 around its injection hole 7: and at least one communication thin hole 10 extending to the swirling flow chamber 9 in the tangential direction is formed at a position in opposition to the peripheral region 17. Since the swirling flow chamber 9 in the back side of each distal end tip 5 has the conical surface 25, the resistance to the flow of the fuel 14 is minimized. Also, this liquid injection nozzle has at least one (six in FIGS. 3 to 6, and two in FIG. 7) communication thin hole 10 is formed in the distal end portion 3 of the nozzle body 1 in such a manner that the at least one communication thin hole 10 extends from the distal-end-side wall surface 15 of the hollow chamber 4 on the distal end side of the valve seat 11 to the wall surface of a tangential flow passage of the swirling flow chamber 9 of the corresponding distal end tip 5. When the valve needle 2 is lifted, the fuel 14 in the liquid passage 8 flows through the communication thin hole 10 into the swirling flow chamber 9 from the tangential flow passage in the tangential direction, whereby a vortex flow (i.e., swirling flow) is generated inside the swirling flow chamber 9 by the conical surface 25, and the vortex flow is sprayed from the injection hole 7 into the external space. Further, at least one communication thin hole 10 is formed for each distal end tip 5. The communication thin hole 10 is formed in the distal end portion 3 of the nozzle body 1 to extend in a predetermined direction inclined in relation to the tangential flow passage. The fuel 14 flows from the communication thin hole 10 into an end portion of the tangential flow passage, and the fuel 14 having flowed into the tangential flow passage flows in the tangential direction toward the conical surface 25 in the peripheral region of the swirling flow chamber 9. The fuel 14 forms a vortex flow in the swirling flow chamber 9 and is sprayed from the injection hole 7 into an external combustion chamber. The sprayed fuel spreads widely and is atomized, whereby mixing between the fuel and air in the combustion chamber or exhaust gas is promoted. In this liquid injection nozzle, since the fuel 14 from the communication thin hole 10 is smoothly introduced along the conical surface 25 of the tangential flow passage, loss of kinetic energy can be reduced.

Figure 8A:
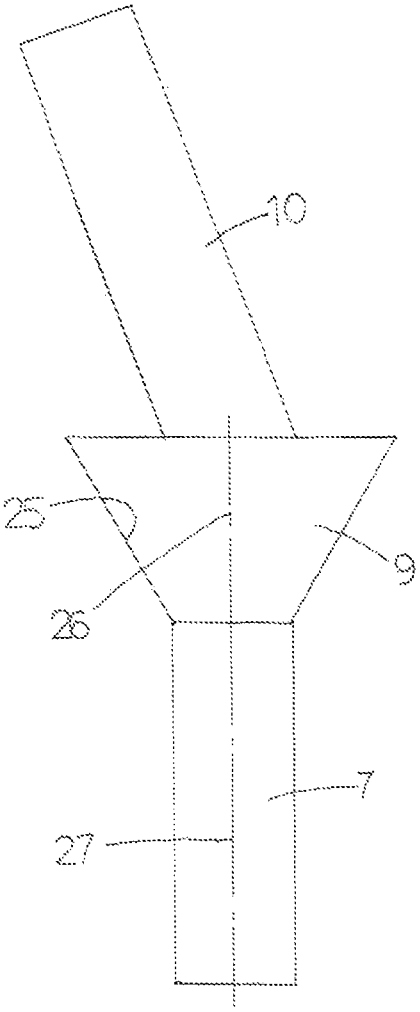
Figure 8B:
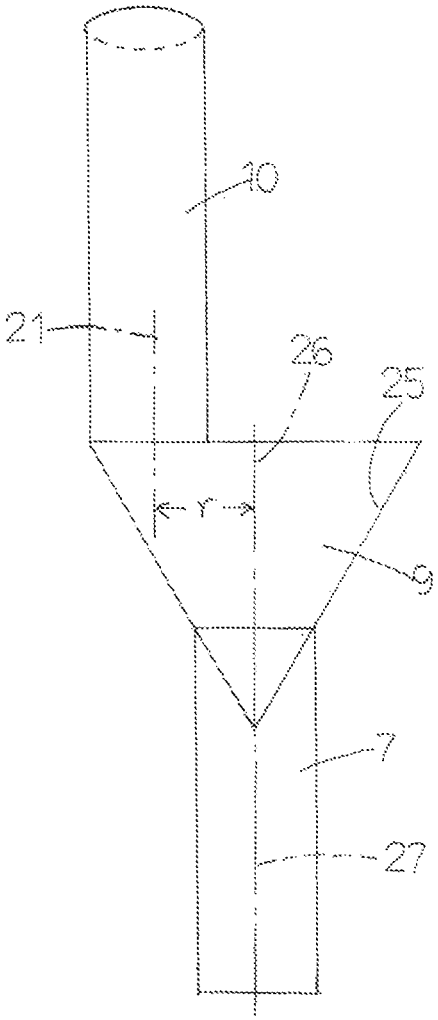
FIG. 8(B) shows that the single communication thin hole formed in the distal end portion of the nozzle body is located eccentrically in relation to the swirling flow chamber formed in the corresponding one of the distal end tips.
Figure 8C:
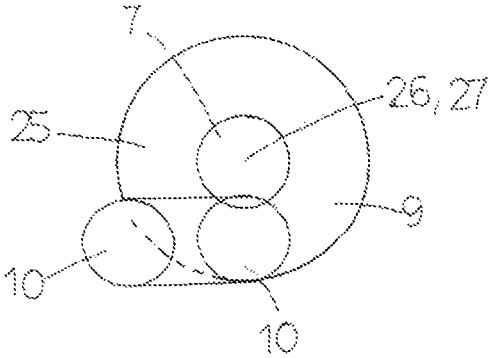
FIG. 8(C) is an explanatory plan view of the communication thin hole, the swirling flow chamber, and the injection hole shown in FIG. 8(A).

The multi-injection-hole structure of a fourth embodiment of the liquid injection nozzle will be described with reference to FIGS. 8(A) to 8(C). FIGS. 8(A), 8(B), and 8(C) show the positional relation among a single communication thin hole 10 formed in the distal end portion 3 of the nozzle body 1 and a swirling flow chamber 9 and an injection hole 7 formed in a distal end tip 5. FIG. 8(A) shows that the axis 27 of the injection hole 7 coincides with the axis 26 of the swirling flow chamber 9. FIG. 8(B) shows that the axis 27 of the injection hole 7 coincides with the axis 26 of the swirling flow chamber 9 and that the axis 21 of the single communication thin hole 10 formed in the distal end portion 3 of the nozzle body 1 is offset by a distance r from the axis of the swirling flow chamber 9 formed in the distal end tip 5. FIG. 8(C) is an explanatory plan view of the communication thin hole 10, the swirling flow chamber 9, and the injection hole 7 shown in FIG. 8(A). The fourth embodiment is a basic type, and a single communication thin hole 10 is provided in the distal end portion 3 for each distal end tip 5. Therefore, the fuel injection nozzle can be manufactured easily and can be manufactured to be stronger than those having a plurality of communication thin holes 10 for each distal end tip 5.

Figure 9A:
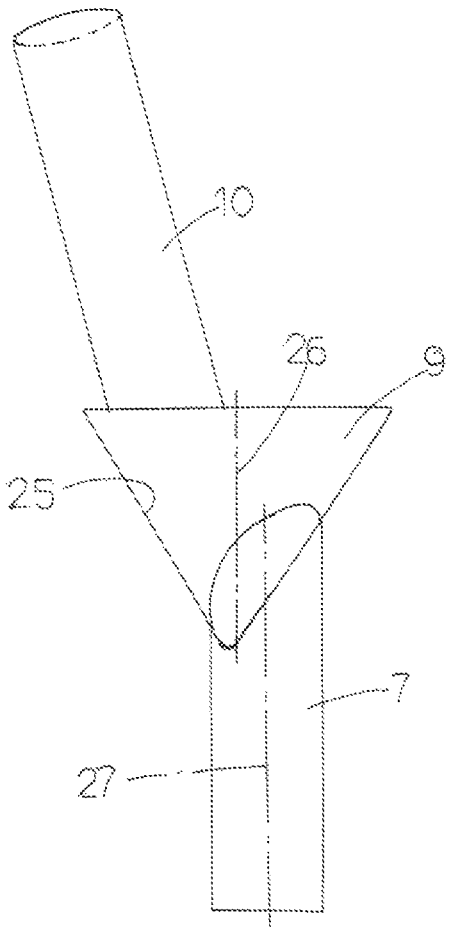
Figure 9B:
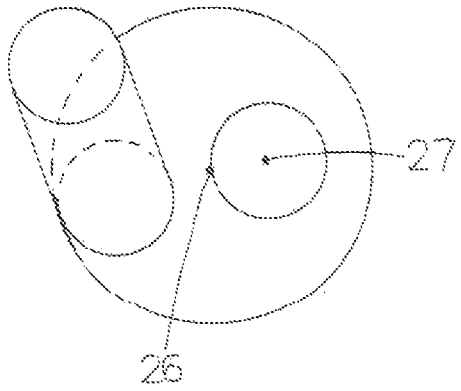

The multi-injection-hole structure of a fifth embodiment of the liquid injection nozzle will be described with reference to FIGS. 9(A) and 9(B). FIGS. 9(A) and 9(B) are explanatory views showing the positional relation among a single communication thin hole 10 formed in the distal end portion 3 of the nozzle body 1 and a swirling flow chamber 9 and an injection hole 7 formed in a distal end tip 5. FIG. 9(A) shows that the axis 26 of the swirling flow chamber 9 and the axis 27 of the injection hole 7 are eccentric in relation to each other. FIG. 9(B) is an explanatory plan view of the communication thin hole 10, the swirling flow chamber 9, and the injection hole 7 shown in FIG. 9(A). In the fifth embodiment, the axis 26 of the swirling flow chamber 9 and the axis 27 of the injection hole 7 are eccentric in relation to each other. Therefore, the generated spray is not uniform and has a locally dense region, which makes it possible to control the generation of an air-fuel mixture in a combustion chamber.

Figure 10A:
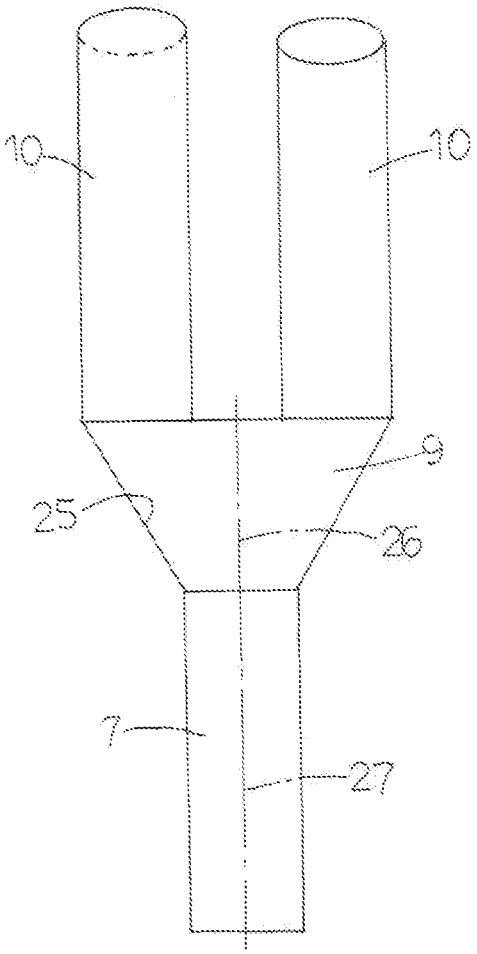
Figure 10B:
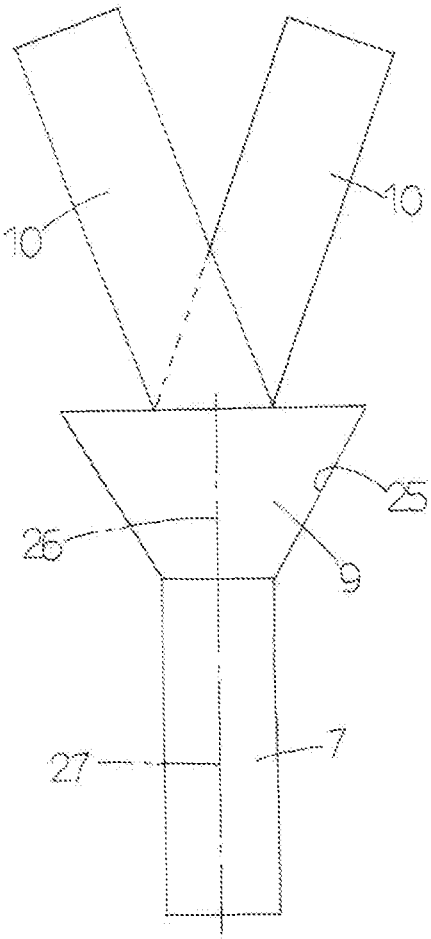
FIG. 10(B) is an explanatory side view of the communication thin holes, the swirling flow chamber, and the injection hole shown in FIG. 10(A) as viewed from a circumferential position shifted 90 degrees from the circumferential position of the side view of FIG. 10(A)
Figure 10C:
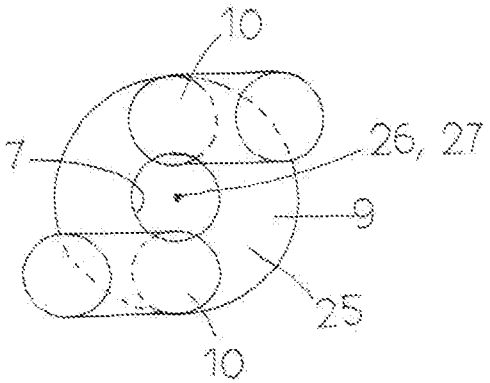
FIG. 10(C) is an explanatory plan view of the communication thin holes, the swirling flow chamber, and the injection hole shown in FIG. 10(B).

The multi-injection-hole structure of a sixth embodiment of the liquid injection nozzle will be described with reference to FIGS. 10(A) to 10(C). FIGS. 10(A), 10(B), and 10(C) are explanatory views showing the positional relation among two communication thin holes 10 formed in the distal end portion 3 of the nozzle body 1 and a swirling flow chamber 9 and an injection hole 7 formed in a distal end tip 5. FIG. 10(A) shows that the two communication thin holes 10 eccentrically communicate with the swirling flow chamber 9 and that the axis 26 of the swirling flow chamber 9 coincides with the axis 27 of the injection hole 7. FIG. 10(B) is an explanatory side view of the communication thin holes 10, the swirling flow chamber 9, and the injection hole 7 shown in FIG. 10(A) as viewed from a circumferential position shifted 90 degrees from the circumferential position of the side view of FIG. 10(A). FIG. 10(C) is an explanatory plan view of the communication thin holes 10, the swirling flow chamber 9, and the injection hole 7 shown in FIG. 10(B). In the sixth embodiment, the liquid injection nozzle has two communication thin holes 10. Therefore, unlike the liquid injection nozzle disclosed in the prior application (Japanese Patent Application Laid-Open No. 2019-15253), within the conical swirling flow chamber 9, the fuel 14 smoothly flows obliquely while contracting and generating a vortex flow along the conical surface 25, without changing its flow direction by 90 degrees. Therefore, it is possible to greatly reduce loss stemming from contracted flow (i.e., greatly reduce pressure loss) and greatly increase the flow rate of the fuel 14.

Figure 11A:
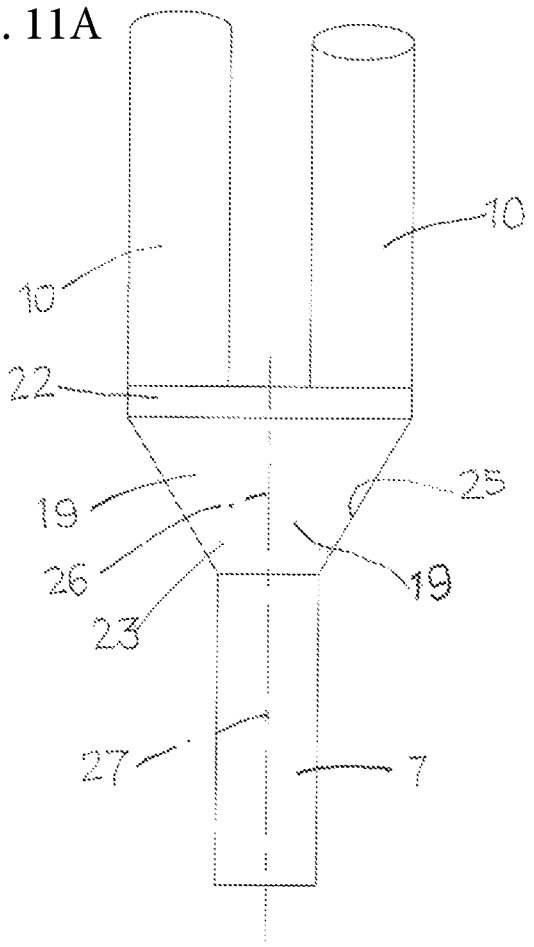
Figure 11B:
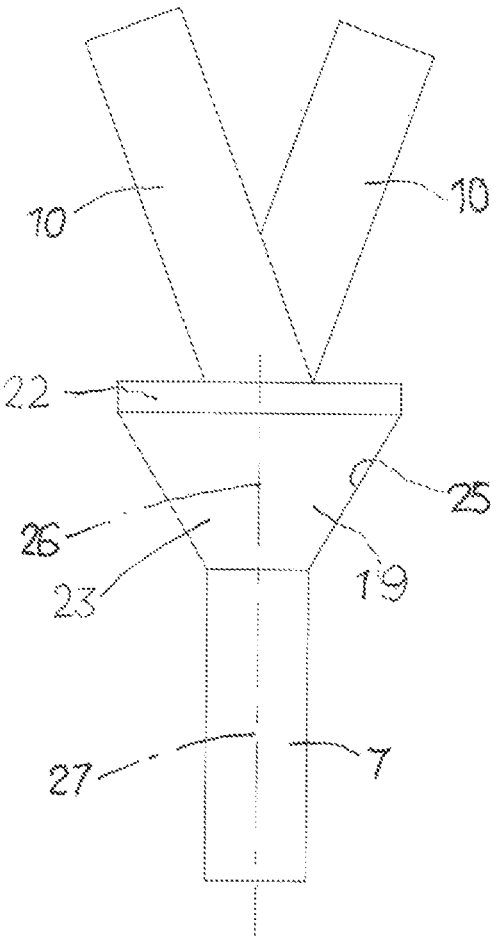
Figure 11C:
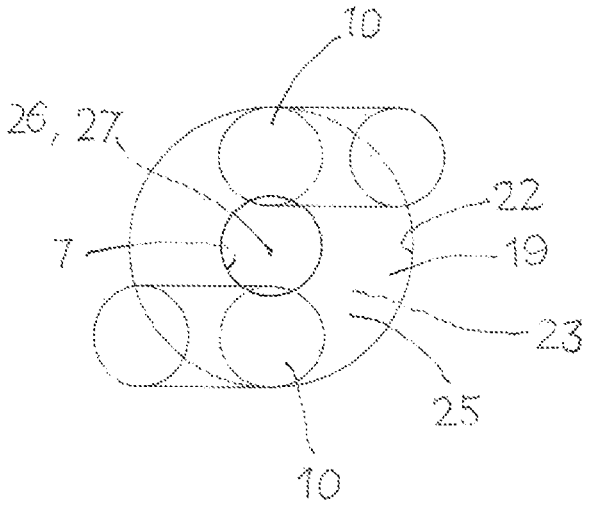

The multi-injection-hole structure of a seventh embodiment of the liquid injection nozzle will be described with reference to FIGS. 11(A) to 11(C). FIGS. 11(A). 11(B), and 11(C) are explanatory views showing the positional relation among two communication thin holes 10 formed in the distal end portion 3 of the nozzle body 1 and a complex swirling flow chamber 19 and an injection hole 7 formed in a distal end tip 5. FIG. 11(A) shows that the two communication thin holes 10 eccentrically communicate with the complex swirling flow chamber 19 and that the axis 26 of the complex swirling flow chamber 19 coincides with the axis 27 of the injection hole 7. FIG. 11(B) is an explanatory side view of the communication thin holes 10, the complex swirling flow chamber 19, and the injection hole 7 shown in FIG. 11(A) as viewed from a circumferential position shifted 90 degrees from the circumferential position of the side view of FIG. 11(A). FIG. 11(C) is an explanatory plan view of the communication thin holes 10, the complex swirling flow chamber 19, and the injection hole 7 shown in FIG. 11(B). In the seventh embodiment, the complex swirl flow chamber 19 is composed of a cylindrical chamber 22 and a conical chamber 23 extending continuously from the cylindrical chamber 22. The two communication thin holes 10 communicate with the complex swirl flow chamber 19. In the complex swirl flow chamber 19, the fuel 14 smoothly flows from the communication thin holes 10 into the cylindrical chamber 22 along its cylindrical surface, without losing the energy of the jetted flow, thereby generating a vortex flow. Subsequently, the vortex flow smoothly flows from the cylindrical chamber 22 into the conical chamber 23. In the conical chamber 23, the fuel 14 smoothly flows obliquely while contracting and intensifying the vortex flow along the conical surface 25. Therefore, it is possible to greatly reduce loss stemming from contracted flow; i.e., greatly reduce pressure loss, and greatly increase the flow rate of the flue 14.

What is claimed is:

1. A liquid injection nozzle comprising:

a nozzle body including a liquid passage having a liquid reserving chamber for supplying liquid; and a valve needle which is reciprocatably inserted into a hollow chamber formed in the nozzle body and extending in a longitudinal direction, wherein a distal end of the valve needle is seated on a valve seat portion formed on a distal-end-side wall surface of the hollow chamber of the nozzle body;

a distal end liquid reserving chamber is formed on a distal end side of the valve seat portion;

a plurality of injection holes defined on a wall surface of the distal end liquid reserving chamber;

when the valve needle is lifted, a liquid passage defined between the distal-end-side wall surface of the hollow chamber of the nozzle body and an outer circumferential surface of the distal end of the valve needle is opened, and the liquid is sprayed from the injection holes into an external space, wherein a plurality of distal end tips having the injection holes defined therein are disposed on a distal end portion of the nozzle body in such a manner that the distal end tips are spaced from one another in a circumferential direction;

wherein each of the distal end tips has a swirling flow chamber defined on an inner side of the distal end tip and having a conical shape, and the injection hole defined on an outer side of the distal end tip and communicating with the swirling flow chamber;

wherein at least one communication thin hole for establishing communication between the distal end liquid reserving chamber and the swirling flow chamber is formed in the distal end portion of the nozzle body, the communication thin hole having an inclination in relation to an axis of the swirling flow chamber, the inclination having a component in an axial direction of the injection hole and a component in a tangential direction of the swirling flow chamber;

wherein the communication thin hole has an inclination angle of 15 degrees to 45 degrees in relation to the axis of the swirling flow chamber, wherein the conical swirling flow chamber is defined in such a manner that its conical wall surface inclines at an angle of 10 degrees to 40 degrees in relation to the axis of the swirling flow chamber, so that the diameter of the swirling flow chamber increases toward a side where the liquid flows into the swirling flow chamber, and wherein when the valve needle is lifted, the liquid in the liquid passage flows through the communication thin hole into the swirling flow chamber and generates a vortex flow in the swirling flow chamber, and the vortex flow is sprayed from the injection hole into the external space.

2. The liquid injection nozzle according to claim 1, wherein the axis of the injection hole is located eccentrically with respect to the axis of the swirling flow chamber.

3. The liquid injection nozzle according to claim 1, wherein the axis of the injection hole is located on the axis of the swirling flow chamber.

4. The liquid injection nozzle according to claim 1, wherein each of the distal end tips is joined to a through hole formed in the distal end portion of the nozzle body.

5. The liquid injection nozzle according to claim 1, wherein the liquid injection nozzle has two communication thin holes which are formed in the distal end portion of the nozzle body for each of the distal end tip; the two communication thin holes are formed at predetermined different positions in opposition to the conical surface of the swirling flow chamber in such a manner that the communication thin holes extend obliquely in relation to the tangential direction and obliquely in relation to each other so that the liquid jetted from one of the communication thin holes and the liquid jetted from the other communication thin hole form vortex flows in the same direction within the swirling flow chamber.

6. The liquid injection nozzle according to claim 1, wherein the liquid injection nozzle has two communication thin holes which are formed in the distal end portion of the nozzle body for each of the distal end tip; and the swirling flow chamber is a complex swirl flow chamber composed of a cylindrical chamber and a conical chamber extending continuously from the cylindrical chamber.

7. The liquid injection nozzle according to claim 1, wherein the liquid is fuel for a super-high pressure type diesel engine.

* * * * *